US006619018B1

(12) United States Patent
Sasaki

(10) Patent No.: US 6,619,018 B1
(45) Date of Patent: Sep. 16, 2003

(54) BAGGING AND PACKAGING MACHINE CAPABLE OF SUFFICIENTLY FILLING AN INERT GAS INTO BAGS

(75) Inventor: Yukio Sasaki, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 252 days.

(21) Appl. No.: 09/639,957

(22) Filed: Aug. 16, 2000

(30) Foreign Application Priority Data

Aug. 16, 1999 (JP) ..... 11-229598

(51) Int. Cl.[7] ..... B65B 31/02; B65B 9/06
(52) U.S. Cl. ..... 53/511; 53/551
(58) Field of Search ..... 53/510, 511, 512, 53/550, 551, 575, 433

(56) References Cited

U.S. PATENT DOCUMENTS 2,145,941 A * 2/1939 Maxfield ..... 206/205
3,664,086 A * 5/1972 James et al. ..... 141/4
4,241,563 A * 12/1980 Muller et al. ..... 53/511
4,478,262 A * 10/1984 Auer ..... 141/114
4,563,862 A * 1/1986 McElvy ..... 53/511
4,640,083 A * 2/1987 Takahashi et al. ..... 141/285
4,738,287 A * 4/1988 Klinkel ..... 141/114
4,964,259 A * 10/1990 Ylvisaker et al. ..... 53/374.8
6,179,015 B1 * 1/2001 Kammler et al. ..... 141/4

FOREIGN PATENT DOCUMENTS

CH 388174 2/1965

* cited by examiner

*Primary Examiner*—Rinaldi I. Rada
*Assistant Examiner*—Paul Durand
(74) *Attorney, Agent, or Firm*—Hogan & Hartson, LLP

(57) ABSTRACT

A bagging and packaging Machine has a substitute gas supply passage provided in a tube member 13 forming a part of a bag former 10 for forming a strip of packaging material into a bag. By securing a generally elongated plate 21 to a front inner side of the tube member 13 to thereby form the substitute gas supply passage 20 that extends in a direction parallel to the longitudinal sense of the packaging material from an upper portion down to a lower end portion of the tube member 13 and by rendering the cross-sectional area of the substitute gas supply passage 21 to be larger at a lower portion thereof than at an upper portion, the structure can be obtained in which a required quantity of substitute gas can be introduced into the bag-shaped packaging material at a moderate flow velocity. In this way, while the speed of packaging operation can be increased and the rate of replacement of the gas can be maintained at a high value, production of defective bagged products which would result from the biting of the articles in the seals consequent upon blow-up of some of the articles within the bag-shaped packaging material can be prevented advantageously.

10 Claims, 8 Drawing Sheets

BAGGING AND PACKAGING MACHINE CAPABLE OF SUFFICIENTLY FILLING AN INERT GAS INTO BAGS

BACKGROUND OF THE INVENTION

1. Field of the Invention

The present invention generally relates to the art of packaging and, more particularly to a bagging and packaging machine for successively forming bags from a strip of bag material and subsequently packaging an article into each of the bags.

2. Description of the Prior Art

In general, the bagging and packaging machine for successively forming bags from a strip of bag material and subsequently packaging an article into each of the bags undergoes a process of forming the strip of bag material, supplied to a bag former, into a tubular form by means of the bag former by overlapping opposite longitudinal side edges with each other; fusion bonding, by means of a longitudinal sealing unit, the overlapped longitudinal side edges of the tubular strip of bag material in a direction longitudinally thereof at an outer surface of a front wall of an article introducing tube member forming a part of the bag former and, concurrently, fusion bonding the tubular strip of bag material in a direction perpendicular to the longitudinal sense of the tubular strip of bag material to form a bottom seal by means of a transverse sealing unit. After an article has been introduced into the tubular strip of bag material through the article introducing tube member, the machine carries out fusion bonding an upper portion of the tubular strip of bag material by means of the transverse sealing unit to form an upper seal to seal the article within the tubular strip of bag material; and finally cutting the tubular strip of bag material along the upper seal to thereby to produce a bagged product containing the article sealed within the bag.

In the practice of this process, where the article filled in each of the successively formed bags is food material, it is a general practice to form the upper seal in the bag after an inert gas such as, for example, nitrogen gas or argon gas has been substituted for air within the bag containing the article therein. The Japanese Laid-open Patent Publication No. 10-53217, for example, discloses,the technique necessitated for this purpose.

The gas replacement device disclosed in the above mentioned publication includes, as shown in FIG. 8, a substitute gas supply passage B extending in a vertical direction along an inner surface of the article introducing tube member A, which passage B has a gas inlet B1 defined at an upper end thereof and a gas outlet B2 defined at a lower end thereof. An inert gas to be substituted for the air within the bag is supplied into the substitute gas supply passage B through the gas inlet B1 and is discharged through the gas outlet B2 into the bag-shaped packaging material C. The inert gas thus supplied into the bag-shaped packaging material C expels the air therefrom so that the inert gas can substitute for the air.

On the other hand, in recent years, the handling capacity of the packaging machine has been desired to increase further. If the rate of replacement with the inert gas is desired to be maintained at a high level in an attempt to increase the handling speed, the flow rate or velocity of the inert gas has to be increased so that the amount of the inert gas supplied per unitary time can be increased. However, increase of the gas flow velocity tends to result in that as shown in FIG. 8, the inert gas is vigorously introduced from the gas outlet B2 at the lower end of the substitute gas supply passage B into the bag-shaped packaging material C and, consequently, some of items X, X, . . . X of the article to be bagged are blown upwardly within the bag-shaped packaging material C or a sufficient introduction of the items X, X, . . . X of the article towards the bottom of the bag-shaped packaging material C is hampered. In such case, when the upper seal is to be formed in the filled bag-shaped packaging material C by means of the transverse sealers D and D of the transverse sealing unit, some of the items X, X, . . . X of the article which have been blown upwards within the bag-shaped packaging material C or which have been retarded to reach the bottom of the bag-shaped packaging-material C are often "bitten" by the transverse sealers D and D, resulting in a defective bagged product.

In an attempt to obviate problems brought about by the blow-up within the bag-shaped packaging material C, it may be contemplated to increase the cross-sectional area of the substitute gas supply passage B over the entire length thereof. However, increase of the cross-sectional area of the substitute gas supply passage B necessitates reduction of the cross-sectional area of the tube member A, which in turn results in lowering the speed at which the items X, X, . . . X of the article are introduced into the bag-shaped packaging material C through the tube member A or clogging of some of the items X, X, . . . X of the article within the tube member A. The consequence is that introduction of a required or desired quantity of the items X, X, . . . X of the article into the bag-shaped packaging material C through the tube member A will take a relatively long time, hampering a high speed packaging operation, or otherwise a possibility will arise that some of the bagged products may contain an insufficient quantity of the items X, X, . . . X of the article.

Also with the prior art structure disclosed in the previously discussed publication, since as shown in FIG. 8 the gas outlet B2 at the lower end of the substitute gas supply passage B opens inwardly of the tube member A, an air curtain of the inert gas discharged from the substitute gas supply passage B is formed at a lower end region of the tube member A, hampering a smooth introduction of the article into the bag-shaped packaging material C through the tube member A. As a result, the handling speed during the packaging operation tends to be lowered, or a possibility will arise that some of the bagged products may contain insufficient quantity of the items X, X, . . . X of the article.

SUMMARY OF THE INVENTION

Accordingly, the present invention has been devised to provide an improved bagging and packaging machine of a type having a gas flush capability, in which the inert gas can be sufficiently introduced to achieve a high rate of gas replacement with neither possibility of the article being bitten, or possibility of the packaging speed being lowered during the sealing of the filled bag.

In order to obviate the problems discussed above, the present invention is featured in that the bagging and packaging machine is constructed as follows.

In the first place, the present invention provides a bagging and packaging machine which includes al bag former including a sailor member and a tube member connected with the sailor member and operable to form a strip of packaging material into a tubular form with opposite longitudinal side edges thereof overlapping with each other, a vertical sealing means for sealing the overlapping longitudinal side edges of the strip of packaging material, which has been formed into the tubular form by the bag former, to provide a longitudinally sealed tubular packaging material, a transverse sealing means for sealing the longitudinally sealed tubular packaging material in a direction generally perpendicular to a longitudinal sense of the longitudinally sealed tubular packaging material to render the latter in a bag form, with articles being introduced into the bag-shaped longitudinally sealed tubular packaging material through the tube member. The bagging and packaging machine further includes a substitute gas supply passage provided inside the tube member for introducing a substitute gas into the bag-shaped longitudinally sealed tubular packaging material for replacement with air inside the bag-shaped longitudinally sealed tubular packaging material. The substitute gas supply passage has a cross-sectional area that is greater at a downstream side thereof than at an upstream side thereof with respect to a direction of flow of the substitute gas.

Preferably, the substitute gas supply passage has a cross-sectional shape having a width that is large at the downstream side thereof such that the substitute gas supply passage has a cross-sectional area that is larger at the downstream side thereof than at the upstream side thereof.

Alternatively or in combination therewith, the substitute gas supply passage preferably has a cross-sectional shape having a thickness that is large at the downstream side thereof such that the substitute gas supply passage has a cross-sectional area that is larger at the downstream side thereof than at the upstream side thereof.

Also preferably, the substitute gas supply passage has a downstream end at the downstream side thereof that is left open in a direction outwardly of the tube member.

In addition, a longitudinal portion of the tube member, which confronts a wall having a surface where the opposite longitudinal side edges of the strip of packaging material are overlapped, is preferably left open.

According to the present invention, since the substitute gas supply passage provided in the tube member forming a part of the bag former has a cross-sectional area that is larger at the downstream side thereof than at the upstream side thereof, it is possible to supply a required quantity of the substitute gas into the bag-shaped longitudinally sealed tubular packaging material at a relatively moderate flow velocity through the opening at the lower end thereof without the cross-sectional area of the article introducing passage within the tube member being unnecessarily narrowed such as occurring in the case where the substitute gas supply passage has a large cross-sectional area over the entire length thereof from the upstream side down to the downstream side thereof Accordingly, without the efficiency of the packaging operation being lowered, and also without the rate of replacement of the gas being lowered, the inconvenience hitherto experienced with the biting of some of the articles which occur when some of the articles within the bag-shaped longitudinally sealed tubular packaging material are blown up by the flow of the substitute gas can advantageously be avoided, thereby avoiding production of defective bagged products.

According to a preferred embodiment of the present invention, since the substitute gas supply passage has a cross-sectional shape having a width that is large at the downstream side thereof and/or having a thickness that is large at the downstream side thereof, the cross-sectional area of the substitute gas supply passage can easily be set larger at the downstream side thereof than at the upstream side thereof.

Also, according to a preferred embodiment of the present invention, since the end of the substitute gas supply passage at the downstream side thereof is left open outwardly of the tube member, there is no possibility that an air curtain of the substitute gas emerging from that opening will be formed at the gas outlet of the tube member, thereby eliminating the possibility that introduction of the articles into the bag-shaped longitudinally sealed tubular packaging material will be hampered.

Again, according to a preferred embodiment of the present invention, since the longitudinal portion of the tube member, which confronts a wall having a surface where the opposite longitudinal side edges of the strip of packaging material are overlapped, is left open, any clogging of the articles to be bagged is advantageously avoided and thus, the introduction of the articles to be bagged through the tube member can take place smoothly in view of the additional fact that the cross-sectional area of the upstream portion of the substitute gas supply passage is so narrowed to secure a sufficient cross-sectional area of the tube member for the introduction of the articles therethrough. Accordingly, any possible reduction of the handling speed can advantageously be further avoided.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
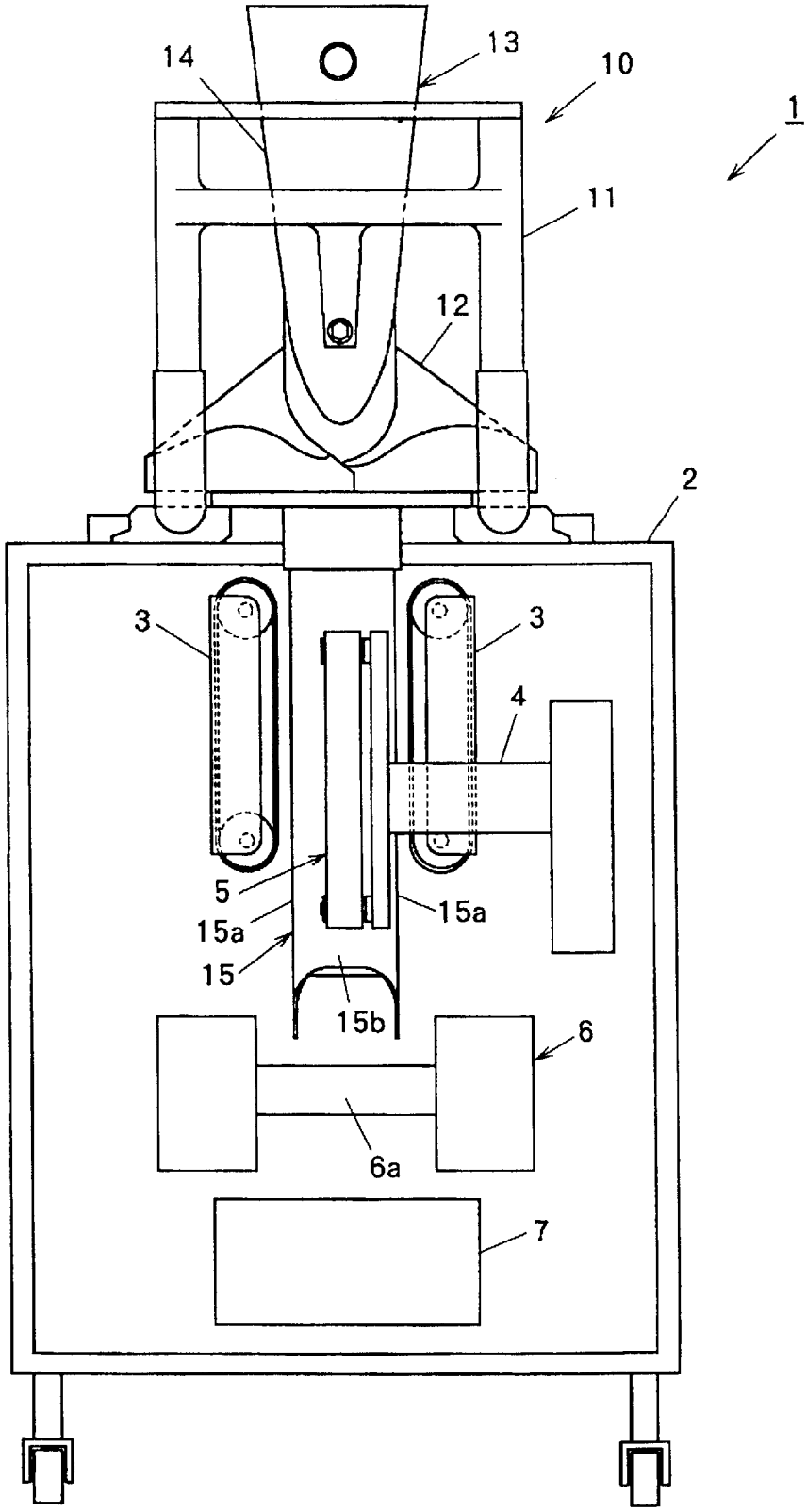
FIG. 1 is a schematic front elevational view of a bagging and packaging machine embodying the present invention.

Hereinafter, a preferred embodiment of the present invention will be described in detail. Referring first to FIG. 1, a bagging and packaging machine 1 embodying the present invention includes a machine framework 2 having a rear upper portion, on which a roll support structure (not shown) for rotatably supporting a roll of packaging material is fixedly mounted, and a front upper portion on which a bag former 10 is mounted.

Figure 2:
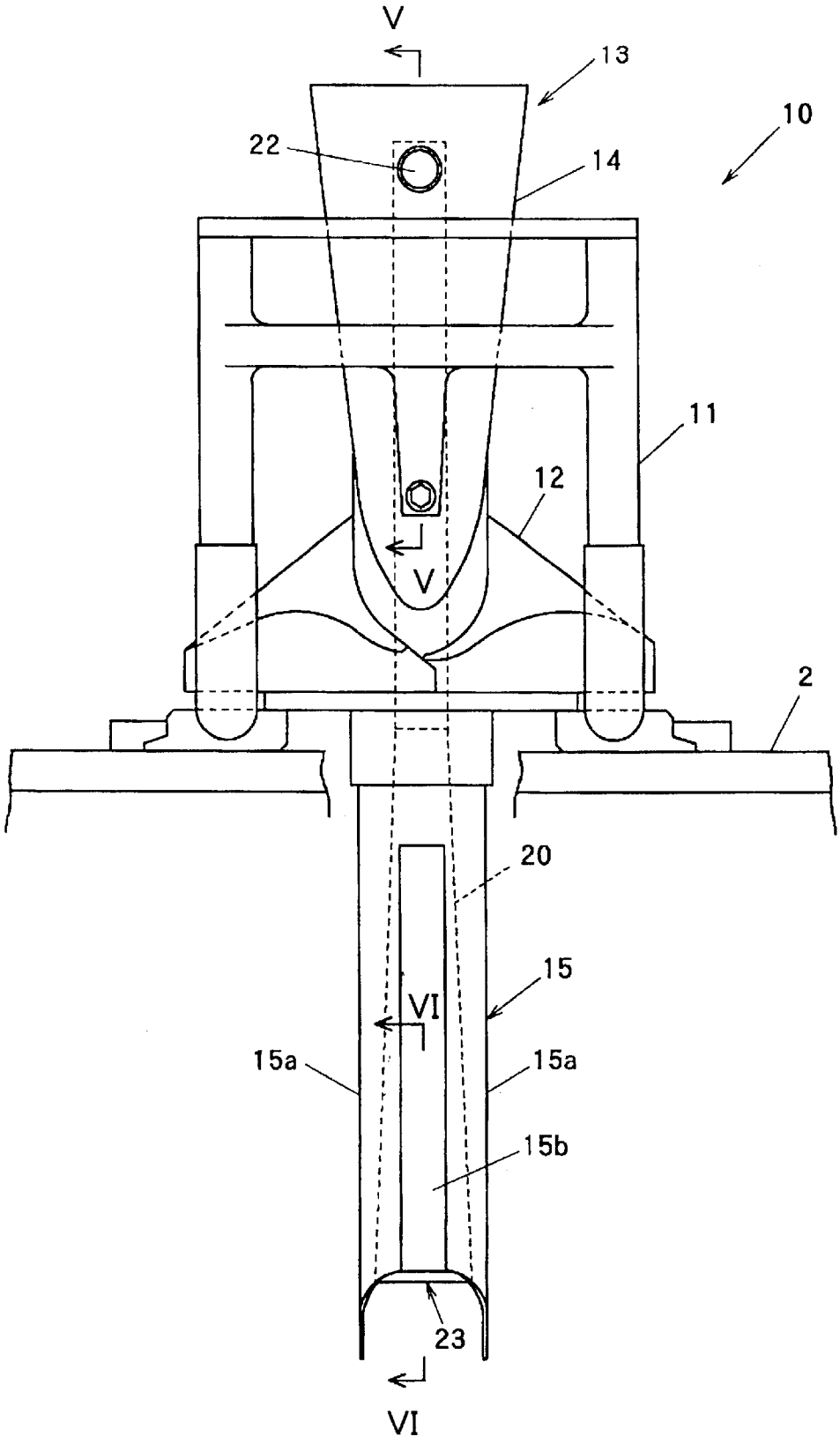
FIG. 2 is a front elevational view, on an enlarged scale, of a bag former employed in the bagging and packaging machine.
Figure 3:
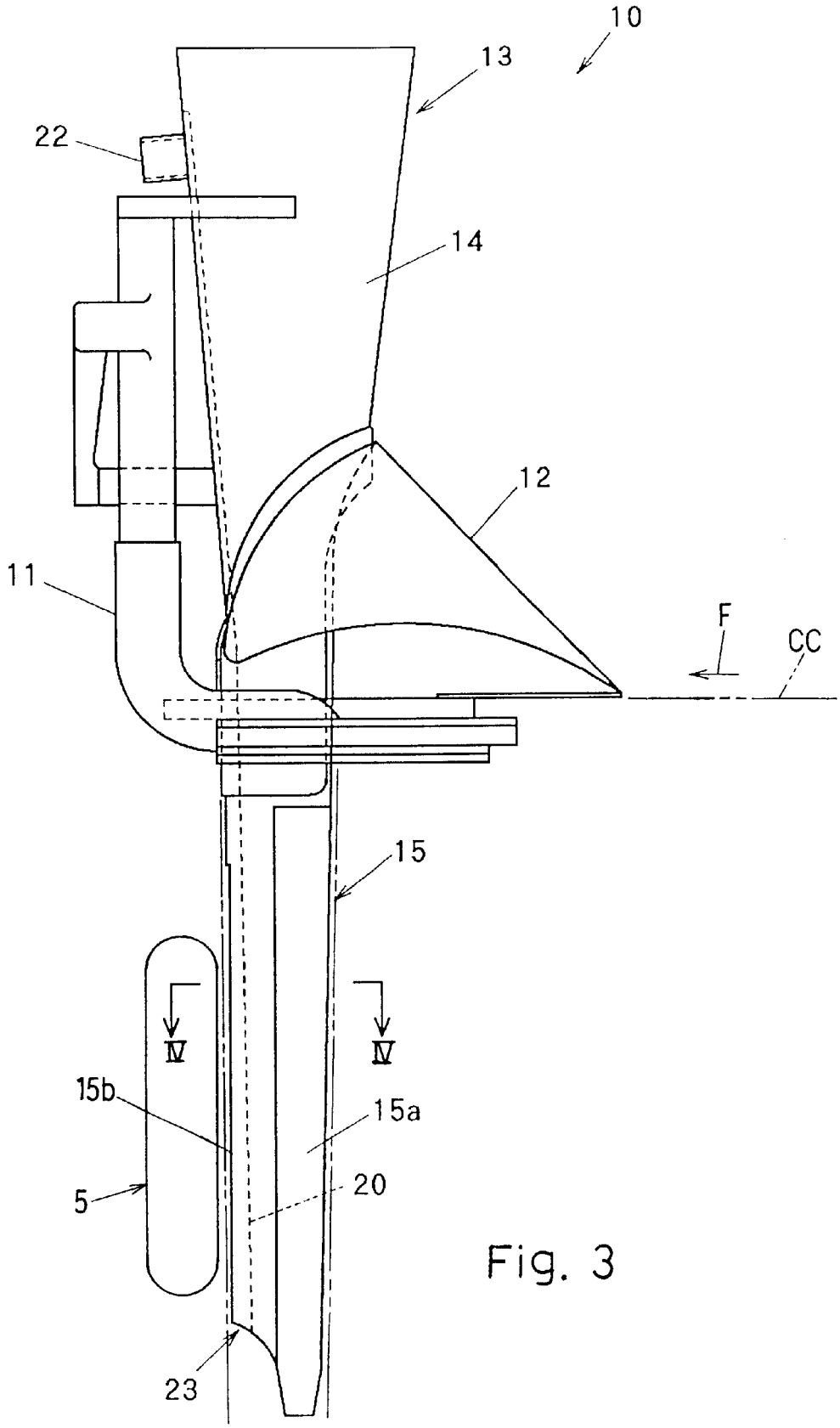
FIG. 3 is a side view, on an enlarged scale, of the bag former employed in the bagging and packaging machine.

The bag former 10 is of a unitary structure including a frame 11 on which a sailor member 12 and a tube member 13 extending vertically through the sailor member 12 are mounted (See particularly FIGS. 2 and 3). This bag former 10 is detachably attached on a front upper surface of the mache framework 2and is, as shown in FIG. 3, so designed and so structured that while a strip CC of packaging material drawn forwards F from the roll of the packaging material is being guided downwards, opposite side edges CC1 and CC2 of the strip CC1 of packaging material shown in FIG. 4 can be overlapped with each other.

In FIG. 1 an upper portion 14 of the tube member 13 that protrudes outwards from the sailor member 12 is of a generally inverted conical shape having been upwardly flared to define a receiving opening into which articles to be bagged can be supplied from above. A lower portion of the tube member 13 that protrudes downwards from the sailor member 12 is adapted to protrude into the packaging material, then formed into a tubular form, to supply the articles into the tubular packaging material.

On left and right sides of the lower portion 15 of the tube member 13, belt-type feeding devices 3 and 3 are disposed with their belts capable of running in a direction generally parallel to the longitudinal direction of the tube packaging material. These belt-type feeding devices 3 and 3 urge circumferentially opposite portions of the tubular ping material against outer surface areas 15*aa* and 15*aa* of correspondingly circumferentially opposite side walls 15*a* and 15*a* of the lower portion 15 so as to draw the tubular packaging material downwards. The overlapping side edges CC1 and CC2 (FIG. 4) of the tubular packaging material that are so formed by the bag former 10 are, as the tubular packaging material is drawn downwards by the belt-type feeding devices 3 and 3 in the manner described above, fusion bonded together to form a longitudinally sealed tubular packaging material by means of a vertical sealing device 5 that is supported at the front of the machine framework 2 by means of a support arm 4.

The circumferentially opposite outer surface areas 15*aa* and 15*aa* of the side walls 15*a* and 15*a* on the lower portion 15 of the tube member 13, with which the respective feeding devices 3 and 3 are brought into contact, and an outer surface area 15*ba* of a front wall 15*b* on the lower portion 15 of the tube member 13 with which the vertical sealing device 5 are brought into contact to fusion bond the overlapping side edges of the tubular packaging material are formed as respective flat surface areas. At the same time, a rear side 15*c* of the lower portion 15 of the tube member 13 that is opposite to the front wall 15*b* is left open to thereby render the cross-section of the lower portion 15 of the tube member 13 to represent a generally C-sectioned configuration as clearly shown in FIG. 4. In other words, the front wall 15*b* and the side walls 15*a* and 15*a* do not lie perpendicular to each other and the lower portion 15 of the tube member 13 has front and side walls 15*b* and 15*a* that are connected, or otherwise continued, to each other through curved connecting walls 15*d* and 15*d* so that the lower portion 15 of the tube member has sectional corners that are generally curved.

Referring again to FIG. 1, somewhat beneath a lower end of the lower portion 15 of the tube member, 13 and at the front of the machine framework 2, there is disposed a transverse sealing device 6 capable of performing a sequential process of clamping the tubular packaging material, of which overlapping side edges thereof have been sealed by the longitudinal sealing unit 5, that is, clamping the longitudinally sealed tubular packaging material from front and rear directions to fuse a predetermined position of the longitudinally sealed tubular packaging material in a transverse direction perpendicular to the direction of feed of the packaging material, cutting the predetermined position of the longitudinally sealed tubular packaging material in the transverse direction to thereby leave a bottom seal in the longitudinally sealed tubular packaging material above the transverse cut line, and forming, after the articles have been filled in a portion of the longitudinally sealed packaging material above the bottom seal, a top seal below the transverse cut line thereby leaving a bagged product. A delivery device 7 for transporting the bagged product towards the subsequent processing station out of the bagging and packaging machine 1

Figure 5:
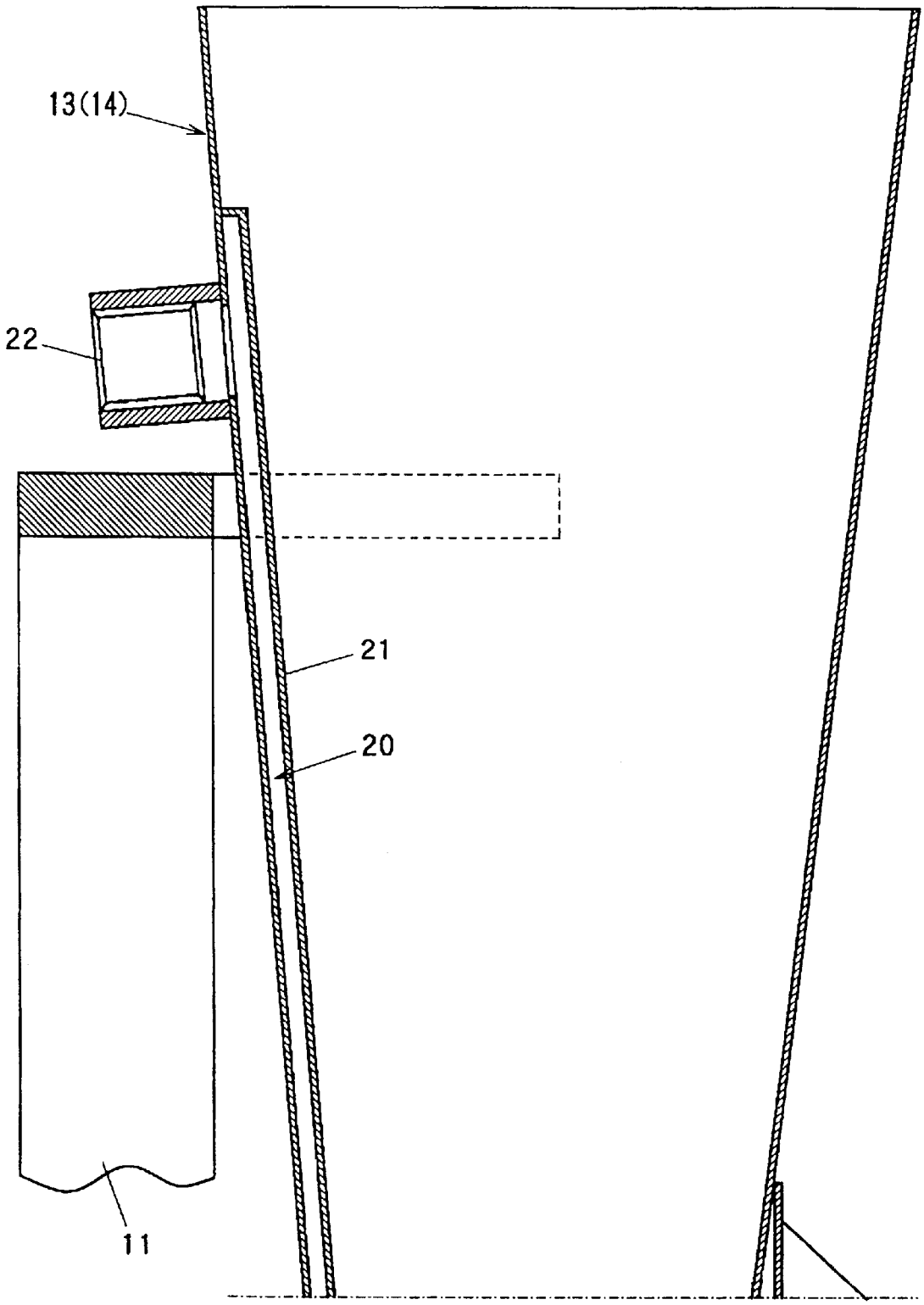
FIG. 5 is a cross-sectional view, on an enlarged scale, taken along the line V—V in FIG. 2, showing a side section of an upper portion of the supply tube.
Figure 6:
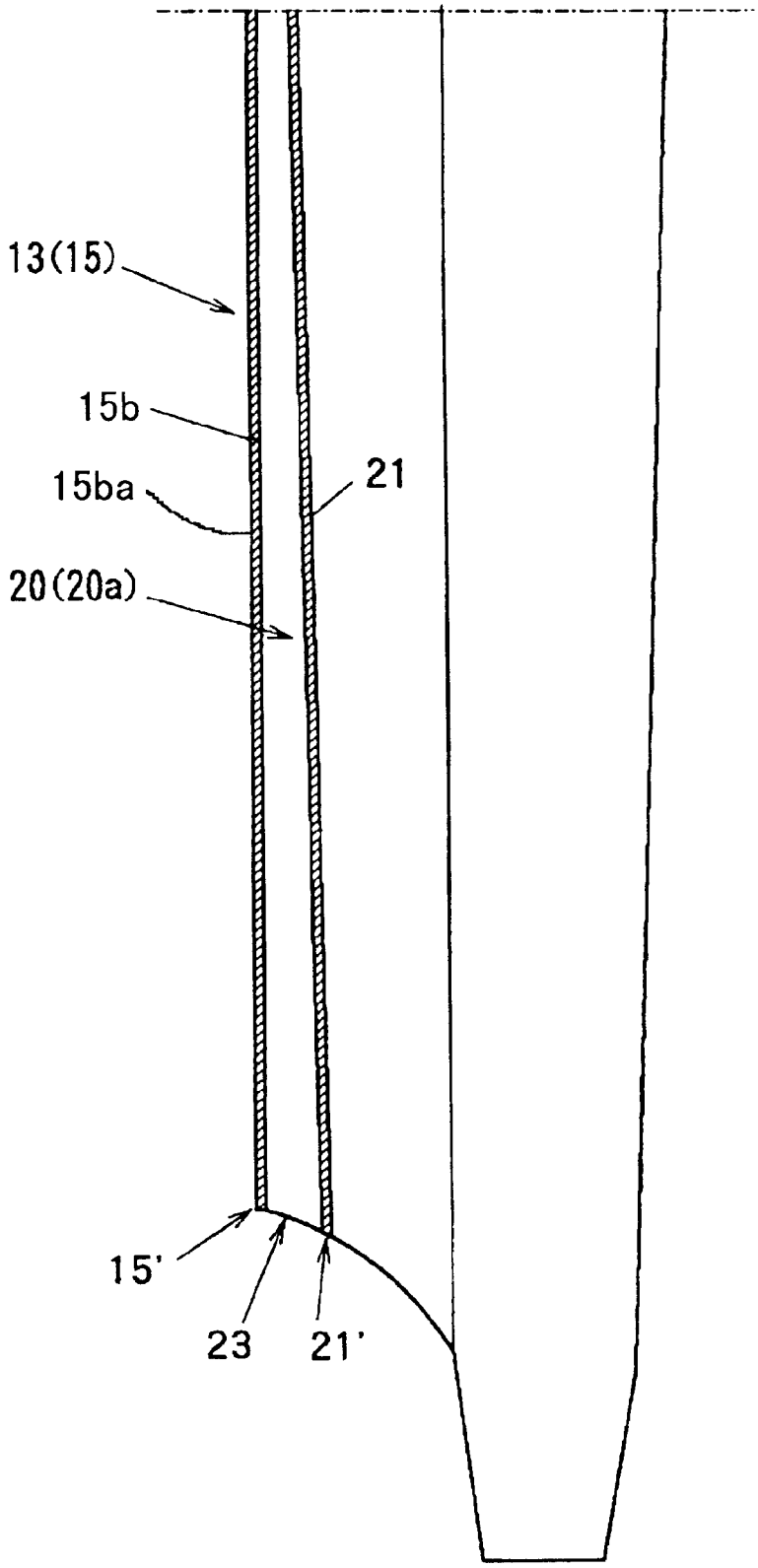
FIG. 6 is a cross-sectional view, on an enlarged scale, taken along the line VI—VI in FIG. 2, showing a side section of a lower portion of the supply tube.

While the bagging and packaging machine 1 is so constructed as hereinabove described, a substitute gas supply passage 20 for the supply of an inert gas into the article filled bag to replace with the air within the article filled bag is defined inside the tube member 13 as best shown in FIGS. 5 and 6 on an enlarged scale. More specifically, the substitute gas supply passage 20 is formed by securing to respective inner surfaces of the connecting walls 15*d* and 15*d* that connect the front and side walls 15*b* and 15*a* of the tube member 13 together, a generally elongated plate 21 of a length sufficient to extend from the upper portion 14 down to the lower end of the lower portion 15 of the tube member so that a longitudinally extending space, which eventually forms the substitute gas supply passage 20, can be formed between the elongated plate 21 and the front wall 15*b* of the tube member 13.

As best shown in FIG. 5, the substitute gas supply passage 20 has an upper end thereof closed by bending an upper end of the elongated plate 21 to connect it to an inner surface of the upper portion 14 of the tube member 13. A gas supply port 22 is formed exteriorly on a front wall of the upper portion 14 of the tube member 13 and is communicated with the substitute gas supply passage 20. A gas supply piping (not shown) is adapted to be connected with the gas supply port 20. Also, as best shown in FIG. 6, the substitute gas supply passage 20 has a lower end left open to thereby define a gas outlet 23.

Figure 4:
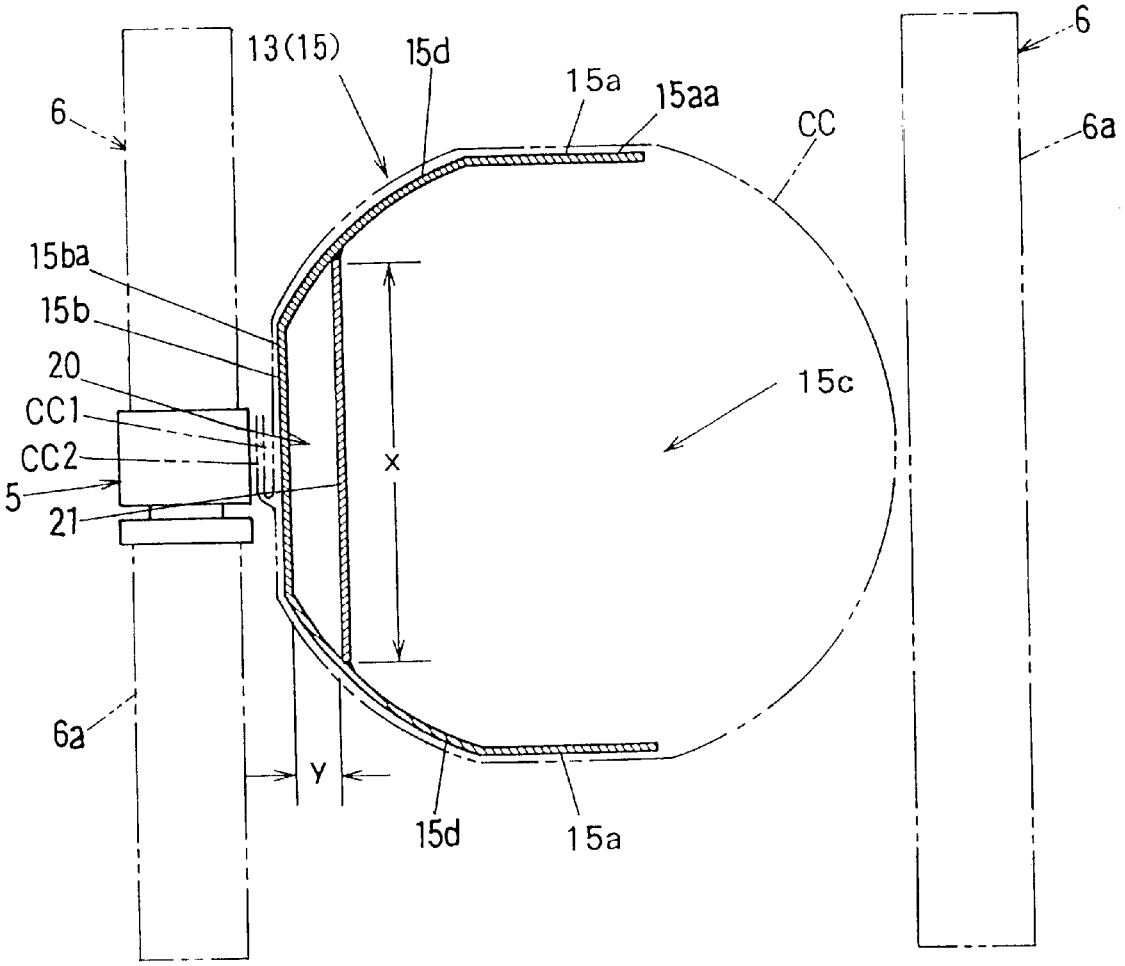
FIG. 4 is a cross-sectional view taken along the line IV—IV in FIG. 3, showing a transverse section of a supply tube.

A lower portion 20*a* of the substitute gas supply passage 20 delimited by the elongated plate 21 and the front wall 15*b* and respective portions of the connecting walls 15*d* and 15*d* of the lower portion 15 of the tube member 13 is so designed and so shaped as to be spaced inwardly away from the inner surface of the front wall 15*b* of the tube member 13 a distance greater than that at an upper portion of the substitute gas supply passage 20, such that the flat cross-section of the substitute gas supply passage 20 can represent a shape having a width x and a thickness y, as shown in FIG. 4, which are greater than those at an upper portion of the substitute gas supply passage 20. Thus, the substitute gas supply passage 20 has a cross-sectional area that is greater at the lower end thereof than at the upper end thereof. The fact that the width x of the cross-sectional shape of the substitute gas supply passage 20 can be increased to have a greater value at the lower end thereof than at the upper end thereof merely by securing the elongated plate 21 in an inclined fashion is because the front wall 15*b* and the side walls 15*a* of the tube member 13 are connected together by means of the curved connecting walls 15*d* and 15*d* and the width x can therefore increase as the elongated plate 21 separates away from the inner surface of the front wall 5*b* of the tube member 13.

Also, as shown in FIG. 6, positioning a lower en of the elongated plate 21 at a location below a lower end 15' of the front wall 15*b* of the tube member 13 renders the gas outlet 23 to open towards the front wall, that 15*b* is, outwardly of the tube member 13.

Hereinafter, the operation of the bagging and packaging machine 1 embodying the present invention will be described.

Figure 7:
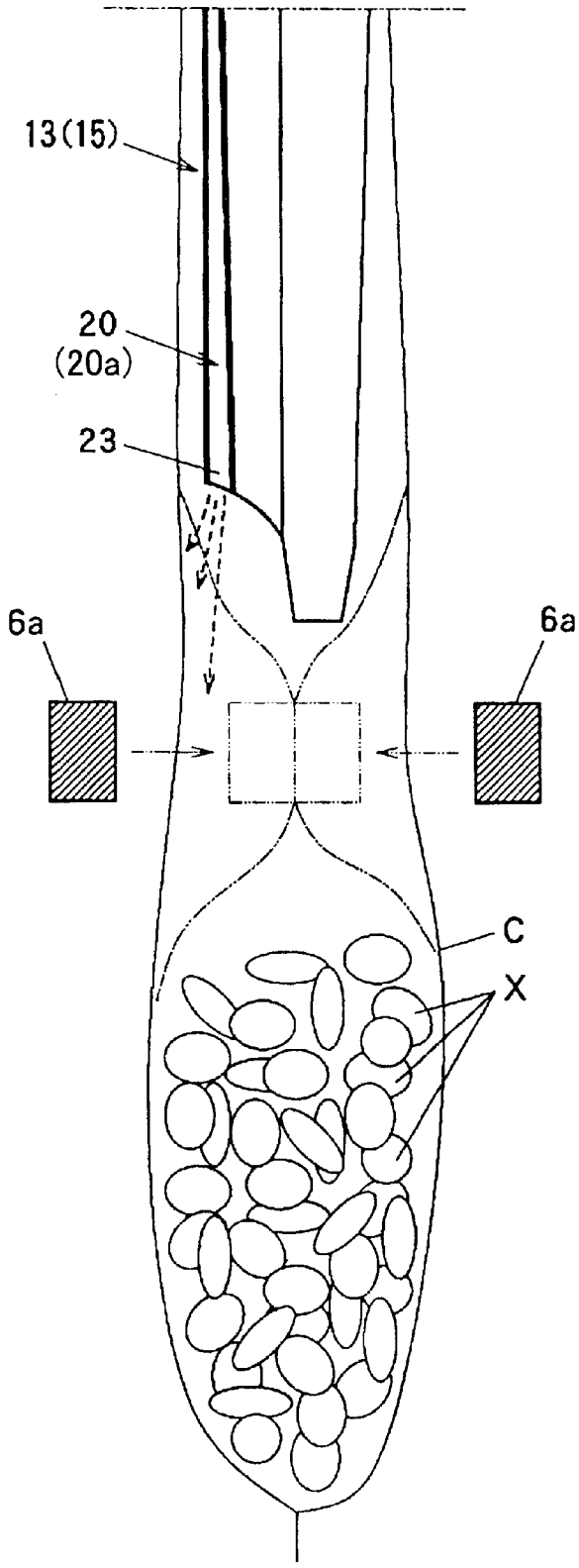
FIG. 7 is an explanatory diagram showing the manner in which a substitute gas is introduced in a lower region of the supply tube.
Figure 8:
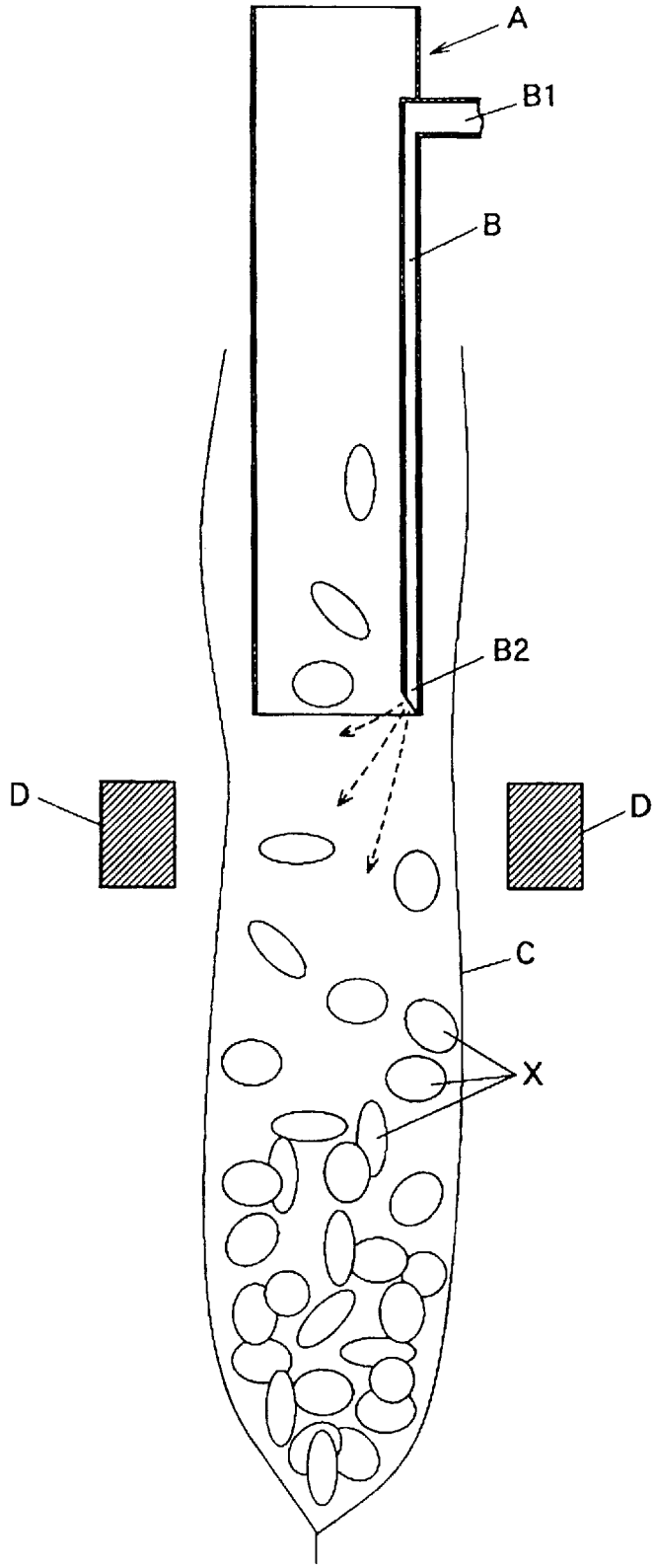
Fig. 8 Prior Art
FIG. 8 is a schematic side sectional view used to explain the problems inherent in the prior art substitute gas supply passage.

When the bagging and packaging machine 1 in FIG. 1 is in operation, the strip CC of packaging material shown in FIG. 3 is drawn forwards F from the roll (not shown) at the rear of the machine framework 2. As the strip CC of packaging material so drawn is fed downwards at a front upper region of the machine framework 2 shown in FIG. 1, the strip CC of packaging material is longitudinally curled by the sailor member 12, forming a part of the tube former 10, with the longitudinal side edges CC1 and CC2 (FIG. 4) thereof consequently overlapped with each other. The strip CC of packaging material is further fed downwards by the feed devices 3 and 3 and the overlapping side edges CC1 and CC2 of the tubular packaging material are fusion bonded together by means of the longitudinal sealing device 5 at the outer surface 15*ba* of the front wall 15*b* on the lower portion 15 of the tube member 13 to thereby form the longitudinally sealed tubular packaging material. At this time, a lower portion of the longitudinally sealed tubular packaging material has already been sealed by the transverse sealing device 6 during the previous cycle of bagging operation and, therefore, the longitudinally sealed tubular packaging material is substantially in the form of a bag having its bottom sealed. Thereafter, the bag-shaped longitudinally sealed tubular packaging material, now identified by C in FIG. 7, is further fed downwards and then filled with the articles X, X . . . X supplied thereinto from above through the tube member 13.

Simultaneously with filling of the articles X, X . . . X into the bag-shaped longitudinally sealed tubular packaging material C, an inert gas such as, for example, nitrogen gas or argon gas is supplied from an external gas supply device (not shown) into the bag-shaped longitudinally sealed tubular packaging material C through the substitute gas supply passage 20. As the inert gas is so supplied, air inside the bag-shaped longitudinally sealed tubular packaging material C is expelled out of the bag-shaped longitudinally sealed tubular packaging material C through, for example, the upper end of the tube member 13 or through a package curling unit constituted by, for example, the sailor member 12 (See FIG. 3) and is therefore replaced with the inert gas.

Thereafter, as shown by the phantom lines in FIG. 7, a portion of the bag-shaped longitudinally sealed tubular packaging material C above the filled articles X, X . . . X is heat sealed by a pair of bar members 6*a* and 6*a* of the transverse sealing device 6 and is, simultaneously therewith, cut to separate from an upstream portion of the longitudinally sealed tubular packaging material to thereby; complete production of a bagged product which subsequently fall by gravity downwards onto the delivery device 7. It is to be noted that a lower end of the upstream portion of the longitudinally sealed tubular packaging material is sealed to define a bottom seal to render the tubular packaging material to be a bag-shaped longitudinally sealed tubular packaging material C in readiness for the subsequent cycle of article filling.

In this way, the bagged products each containing a predetermined quantity of articles filled therein and also containing the inert gas filled therein in place of the air can be continuously manufactured and successively transported by the delivery device 7 (See FIG. 1) towards the next subsequent processing station out of the bagging and packaging machine 1.

In such case, particularly in the bagging and packaging machine 1 embodying the present invention, since the lower portion 20*a* of the substitute gas supply passage 20 has a cross-sectional area that progressively increases downwards thereof, the velocity of flow of the inert gas at the time of being introduced into the bag-shaped longitudinally sealed tubular packaging material C through the gas outlet 23 at the lower end of the substitute gas supply passage 20 is relatively low even though the velocity of flow of the inert gas at the gas supply port 22 is increased in concomitance with increase of the packaging speed.

Accordingly, there is no possibility that the inert gas is vigorously introduced into the bag-shaped longitudinally sealed tubular packaging material C, accompanied by blow-up of some or all of the articles X, X . . . X within the bag-shaped longitudinally sealed tubular packaging material C and/or any possible disturbance to the introduction of the articles X, X . . . X into the bag-shaped longitudinally sealed tubular packaging material C. Thus, with the bagging and packaging machine embodying the present invention, the articles X, X . . . X can be satisfactorily and effectively introduced into the bag-shaped longitudinally sealed tubular packaging material C and, also, any possible biting of some of the articles X, X . . . X by the paired bar members 6*a* and 6*a* of the transverse sealing device 6 can also be eliminated.

Also, since the substitute gas supply passage 20 has its upper portion having a relatively small cross-sectional area, the cross-sectional area of the tube member 13 itself will not be sacrificed and, accordingly, even at the upper portion of the tube member 13 which is not left open at the rear side thereof, fall of the articles to be supplied into the bag-shaped longitudinally sealed tubular packaging material C is not hampered. In addition, since the gas outlet 23 at the lower end of the substitute gas supply passage 20 is opened in a direction outwardly of the tube member 13, there is no possibility of an air curtain of the substitute gas being formed at a lower open end of the tube member 13, thereby eliminating the possibility that introduction of the articles X, X . . . X into the bag-shaped longitudinally sealed tubular packaging material C will be hampered.

Furthermore, according to the foregoing embodiment of the present invention, since the rear side 15*c* of the lower portion 15 of the tube member 13 that is enclosed by the longitudinally sealed tubular packaging material is left open, clogging of the articles X,X . . . X will not occur at that portion inside the tube member 13 and, accordingly, introduction of the articles into the bag-shaped longitudinally sealed tubular packaging material C through the tube member 13 takes place smoothly, thereby facilitating filling of the articles to the bottom of the bag-shaped longitudinally sealed tubular packaging Material C.

Thus, it has now become clear that while any possible reduction of the handling speed during the bagging and packaging operation is avoided, and the quantity of the inert, gas supplied per unitary time is increased to attain a high gas replacement rate even when the handling speed is increased, production of defective bagged products which would result from the biting of the articles in the seals can be prevented advantageously.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention.

By way of example, although in the foregoing embodiment of the present invention, the substitute gas supply passage 20 has been shown and described as formed between the front wall 15*b* of the tube member 13 and the elongated plate 21, effects similar to those described hereinabove can be obtained even when a tubular substitute gas supply pipe having a cross-sectional area that is greater at the lower portion thereof than at the upper portion is disposed within the tube member 13.

Accordingly, such changes and modifications are, unless they depart from the scope of the present invention as delivered from the claims annexed hereto, to be construed as included therein.

What is claimed is:

1. A bagging and packaging machine which comprises:

a bag former including a sailor member and a tube member connected with the sailor member and operable to form a strip of packaging material into a tubular form with opposite longitudinal side edges thereof overlapping with each other;

a vertical sealing means for sealing the overlapping longitudinal side edges of the strip of packaging material, which has been formed into the tubular form by the bag former, to provide a longitudinally sealed tubular packaging material;

a substitute gas supply passage provided inside the tube member for introducing a substitute gas into the bag-shaped longitudinally sealed tubular packaging material for replacement of air inside the bag-shaped longitudinally sealed tubular packaging material, said substitute gas supply passage having a cross-sectional area that is greater at a downstream side thereof than at an upstream side thereof with respect to a direction of flow of the substitute gas; and a transverse sealing means for sealing the longitudinally sealed tubular packaging material in a direction generally perpendicular to a longitudinal sense of the longitudinally sealed tubular packaging material to render the latter in a bag form, with articles introduced into the bag-shaped longitudinally sealed tubular packaging material through the tube member;

wherein the substitute gas has a composition other than that of air; and wherein a longitudinal portion of the tube member, which is opposite a wall having a surface where the opposite longitudinal side edges of the strip of packaging material are overlapped, is left open.

2. A bagging and packaging machine which comprises:

a bag former including a sailor member and a tube member connected with the sailor member and operable to form a strip of packaging material into a tubular form with opposite longitudinal side edges thereof overlapping with each other;

a vertical sealing means for sealing the overlapping longitudinal side edges of the strip of packaging material, which has been formed into the tubular form by the bag former, to provide a longitudinally sealed tubular packaging material;

a substitute gas supply passage provided inside the tube member for introducing a substitute gas into the bag-shaped longitudinally sealed tubular packaging material for replacement of air inside the bag-shaped longitudinally sealed tubular packaging material, said substitute gas supply passage having a cross-sectional area that is greater at a downstream side thereof than at an upstream side thereof with respect to a direction of flow of the substitute gas; and a transverse sealing means for sealing the longitudinally sealed tubular packaging material in a direction generally perpendicular to a longitudinal sense of the longitudinally sealed tubular packaging material to render the latter in a bag form, with articles introduced into the bag-shaped longitudinally sealed tubular packaging material through the tube member;

wherein the substitute gas has a composition other than that of air; and wherein said substitute gas sup;ply passage has a gas outlet disposed downstream of the sailor member.

3. A bagging and packaging machine which comprises:

a bag former including a sailor member and a tube member connected with the sailor member and operable to form a strip of packaging material into a tubular form with opposite longitudinal side edges thereof overlapping with each other;

a vertical sealing means for sealing the overlapping longitudinal side edges of the strip of packaging material, which has been formed into the tubular form by the bag former, to provide a longitudinally sealed tubular packaging material;

a substitute gas supply passage provided inside the tube member for introducing a substitute gas that is an inert gas into the bag-shaped longitudinally sealed tubular packaging material for replacement of air inside the bag-shaped longitudinally sealed tubular packaging material, said substitute gas supply passage having a gas outlet disposed downstream of the sailor member and also having a cross-sectional area that is greater at a downstream side thereof than at an upstream side thereof with respect to a direction of flow of the substitute gas; and a transverse sealing means for sealing the longitudinally sealed tubular packaging material in a direction generally perpendicular to a longitudinal sense of the longitudinally sealed tubular packaging material to render the latter in a bag form, with articles introduced into the bag-shaped longitudinally sealed tubular packaging material through the tube member.

4. The bagging and packaging machine as claimed in claim 3, wherein the substitute gas, supply passage has a cross-sectional shape having a width that is large at the downstream side thereof such that the substitute gas, supply passage has a cross-sectional area that is larger at the downstream side thereof than at the upstream side thereof.

5. The bagging and packaging machine as claimed in claim 3, wherein the substitute gas supply package has a cross-sectional shape having a thickness that is large at the downstream side thereof such that the substitute gas supply passage has a cross-sectional area that is larger at the downstream side thereof than at the upstream side.

6. The bagging and packaging machine as claimed in claim 3, wherein the substitute gas supply passage has a downstream end at the downstream side thereof that is left open in a direction outwardly of the tube member.

7. The bagging and packaging machine as claimed in claim 3, wherein a longitudinal portion of the tube member, which is opposite a wall having a surface where the opposite longitudinal side edges of the strip of packaging material are overlapped, is left open.

8. The bagging and packaging machine as claimed in claim 3, wherein the inert gas is selected from the group consisting of nitrogen gas and argon gas.

9. A bagging and packaging machine comprising:

a bag former including a tube member, the bag former operable to form a strip of packaging material into a tubular form around the tube member with opposite longitudinal side edges thereof overlapping with each other;

a vertical sealer operable to seal the overlapping longitudinal side edges of the strip of packaging material, which has been formed into the tubular form by the bag former, to provide a longitudinally sealed tubular packaging material;

a substitute gas supply passage provided inside the tube member and operable to introduce a substitute gas into the longitudinally sealed tubular packaging material for replacement of air inside the longitudinally sealed tubular packaging material, said substitute gas supply passage having a cross-sectional area that is greater at a downstream side thereof than at an upstream side thereof with respect to the direction of flow of the substitute gas;

wherein the substitute gas has a composition other than that of air; and wherein a longitudinal portion of the tube member, which is opposite a wall having a surface where the opposite longitudinal side edges of the strip of packaging material are overlapped, is left open.

10. A bagging and packaging machine comprising:

a bag former including a tube member, the bag former operable to form a strip of packaging material into a tubular form around the tube member with opposite longitudinal side edges thereof overlapping with each other;

a vertical sealer operable to seal the overlapping longitudinal side edges of the strip of packaging material, which has been formed into the tubular form by the bag former, to provide a longitudinally sealed tubular packaging material;

a substitute gas supply passage provided inside the tube member and operable to introduce a substitute gas into the longitudinally sealed tubular packaging material for replacement of air inside the longitudinally sealed tubular packaging material, said substitute gas supply passage having a cross-sectional area that is greater at a downstream side thereof than at an upstream side thereof with respect to the direction of flow of the substitute gas, wherein the substitute gas has a composition other than that of air; and a sailor member that operates in cooperation with the tube member to form the strip of packaging material into the tubular form;

wherein said substitute gas supply passage has a gas outlet disposed downstream of the sailor member.

* * * * *